US009016263B2

(12) United States Patent
Zeng et al.

(10) Patent No.: US 9,016,263 B2
(45) Date of Patent: Apr. 28, 2015

(54) HIGH PRESSURE FUEL PUMP

(71) Applicant: Ford Global Technologies, LLC, Dearborn, MI (US)

(72) Inventors: Paul Zeng, Inkster, MI (US); Vince Paul Solferino, Dearborn, MI (US); Patrick Brostrom, Clarkston, MI (US); Kyi Shiah, Northville, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 256 days.

(21) Appl. No.: 13/658,701

(22) Filed: Oct. 23, 2012

(65) Prior Publication Data

US 2014/0003966 A1 Jan. 2, 2014

Related U.S. Application Data

(60) Provisional application No. 61/665,206, filed on Jun. 27, 2012.

(51) Int. Cl.

| | |
|---|---|
| ***F02M 63/00*** | (2006.01) |
| ***F02D 41/38*** | (2006.01) |
| ***F02M 63/02*** | (2006.01) |
| ***F02M 59/34*** | (2006.01) |

(Continued)

(52) U.S. Cl.

CPC ..... *F02M 63/0056* (2013.01); *F02M 59/44* (2013.01); *F02D 41/3845* (2013.01); *F02M 37/06* (2013.01); *F02M 37/0047* (2013.01); *F02M 63/023* (2013.01); *F02M 59/34* (2013.01); *F02M 63/0015* (2013.01)

(58) Field of Classification Search

CPC ..... F02M 59/44; F02M 37/06; F02D 41/3845
USPC ..... 123/495, 496, 500, 506, 508, 510; 417/510; 137/56, 250, 315.17, 331, 137/447, 625.15, 625.21, 601.15, 601.17
See application file for complete search history.

(56) References Cited

U.S. PATENT DOCUMENTS 3,237,644 A * 3/1966 Beck et al. ..... 137/624.18
3,747,630 A * 7/1973 Hurrell ..... 137/312

(Continued)

FOREIGN PATENT DOCUMENTS

JP H0481559 A 3/1992
JP 2010168901 A 8/2010

OTHER PUBLICATIONS

Zeng, Paul et al., "Fuel Pump with Quiet Cam Operated Suction Valve," U.S. Appl. No. 13/399,713, filed Feb. 17, 2012, 47 pages.

(Continued)

*Primary Examiner* — Mahmoud Gimie
(74) *Attorney, Agent, or Firm* — James Dottavio; Alleman Hall McCoy Russell & Tuttle LLP

(57) ABSTRACT

A high pressure fuel pump for use with an internal combustion engine and a method of operation of a high pressure fuel pump are disclosed. The high pressure fuel pump may include a supply chamber and a pump chamber separated by a passage in sealing arrangement with a disk. The disk may have one or more holes therethrough and be rotatable in order to place the holes in the disk in varying degrees of alignment with the passage to allow respective, varying amounts of fuel to flow through the passage.

19 Claims, 5 Drawing Sheets

(51) Int. Cl.

| | |
|---|---|
| *F02M 59/44* | (2006.01) |
| *F02M 37/06* | (2006.01) |
| *F02M 37/00* | (2006.01) |

(56) References Cited

U.S. PATENT DOCUMENTS

| | | | | |
|---|---|---|---|---|
| 3,880,402 | A * | 4/1975 | Fleischer | 251/212 |
| 4,526,060 | A * | 7/1985 | Watanabe | 475/4 |
| 5,118,418 | A * | 6/1992 | Roussel | 210/278 |
| 8,210,156 | B2 * | 7/2012 | Kokotovic et al. | 123/458 |
| 2003/0217725 | A1 * | 11/2003 | Klein et al. | 123/198 A |
| 2004/0183371 | A1 | 9/2004 | Zheng et al. | |
| 2006/0228239 | A1 * | 10/2006 | Usui et al. | 417/470 |
| 2008/0236193 | A1 | 10/2008 | Chen | |
| 2012/0000445 | A1 | 1/2012 | Borg et al. | |
| 2012/0090574 | A1 | 4/2012 | Surnilla et al. | |
| 2012/0207632 | A1 * | 8/2012 | Usui et al. | 417/440 |

OTHER PUBLICATIONS

Zeng, Paul et al., "Fuel Pump with Quiet Rotating Suction Valve," U.S. Appl. No. 13/399,842, filed Feb. 17, 2012, 48 pages.

Zeng, Paul et al., "Fuel Pump with Quiet Volume Control Operated Suction Valve," U.S. Appl. No. 13/399,897, filed Feb. 17, 2012, 47 pages.

Zeng, Paul et al., "Fuel Pump with Metering Valve," U.S. Appl. No. 13/706,131, filed Dec. 5, 2012, 36 pages.

* cited by examiner

HIGH PRESSURE FUEL PUMP

CROSS-REFERENCE TO RELATED APPLICATIONS

This application claims priority to U.S. Patent Application No. 61/665,206 filed on Jun. 27, 2012, the entire contents of which are hereby incorporated herein by reference for all purposes.

FIELD

The present application relates generally to fuel supply pumps, including methods and systems for controlling a high pressure fuel pump. In some embodiments, the application relates to a pump, a pump arrangement, and methods to reduce noise emitted from a high pressure pump for use with internal combustion engines wherein valve movement is rotational and without reciprocating impact.

BACKGROUND AND SUMMARY

Direct-injection engines inject fuel at high pressure directly into the engine's combustion chambers. The fuel may be injected via a common fuel rail. The fuel may be pressurized using a high pressure fuel pump, sometimes referred to as a supply pump. The high pressure fuel pump can be a source of undesired engine noise. In particular, the high pressure fuel pump can produce a ticking noise. Research and test data show that the ticking noise occurs as the pump's magnetic solenoid valve (MSV) opens and closes, resulting in an armature-to-stopper impact at closing, or suction valve-to-seat impact at opening. This impact energy not only excites the pump itself but may also be transmitted to the cylinder head through the pump mount. Furthermore, the energy may also travel to other engine components, e.g. the engine block, oil pan, cam covers, front cover, intake and exhaust manifolds. This may have the effect of amplifying the unwanted noise, making it more noticeable especially during engine idle conditions when these other engine components are relatively quiet.

Attempts have been made to reduce the noise emitted from high pressure fuel supply pumps. For example, US Patent Application #20120000445 to BORG et al. discloses a method and control apparatus for controlling a high-pressure fuel supply pump. The disclosed approach decreases a control current of a normally-closed type solenoid-actuated intake valve so that the movement in the opening direction can be decelerated by means of a biasing force at the time of hitting a mechanical stop at the fully-opened position, thereby reducing the impact noise.

The inventors have recognized several potential issues with these approaches. For example, although this approach may reduce impact it may still be great enough to add to unwanted engine noise. Further, it is believed that the decelerated motion may become less synchronized with the moment of impact as the impacted surfaces age and deform over time, and unwanted noise may consequently increase.

In view of these issues, the inventors have taken an approach that reduces valve-to-valve seat impact and may completely eliminate the impact at pump close and open events. Embodiments in accordance with the present disclosure may comprise a valve arrangement including a rotatable disk configured to separate a fuel supply chamber from a pump chamber. There may be one or more holes through the disk designed to correspond to one or more holes in the valve housing. When the valve is at an open position, the disk holes may be configured to align with the valve housing holes to allow fuel flow from the fuel supply chamber to the pump chamber, and vice versa. Since the disk valve may influence fuel flow by rotation, impact between the disk and the valve housing is avoided. In this way the process may generate significantly less noise, and by eliminating any ticking noises the fuel pump may operate almost silently.

Additional examples as per the present disclosure may include a passage separating first and second chambers of the valve arrangement, such as a wall separating a supply chamber and pump chamber. The rotatable disk may be in a sealing arrangement with the wall, and may have one or more holes corresponding to one or more holes in the wall. Gear teeth may be present on at least part of the disk perimeter capable of meshing with a worm screw or similar driving element. The worm may be actuated by a controller and/or a cam or other mechanism.

These embodiments may incorporate methods of establishing a pressure differential between the fuel supply and pump chamber to influence fuel flow when the disk is aligned to allow fuel to pass through. The pump chamber may include a plunger which increases or decreases pressure within the chamber. By adjusting pressure the plunger may also assist in compressing fuel and/or pushing it towards a combustion chamber.

Methods of operation as described may include a controller, attached to a driving element, triggering rotation of the disk based on pre-selected engine operation conditions. Embodiments driven by a worm gear or similar element may have rotation sequences which are influenced by the positioning of a cam. The cam may be responsive to different engine operation conditions, such as engine fuel and/or fuel pressure demand, and may also influence movement of a plunger within the pump chamber.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIGS. 4-7 are drawn approximately to scale, although other relative dimensions may be used, if desired.

DETAILED DESCRIPTION

Figure 1:
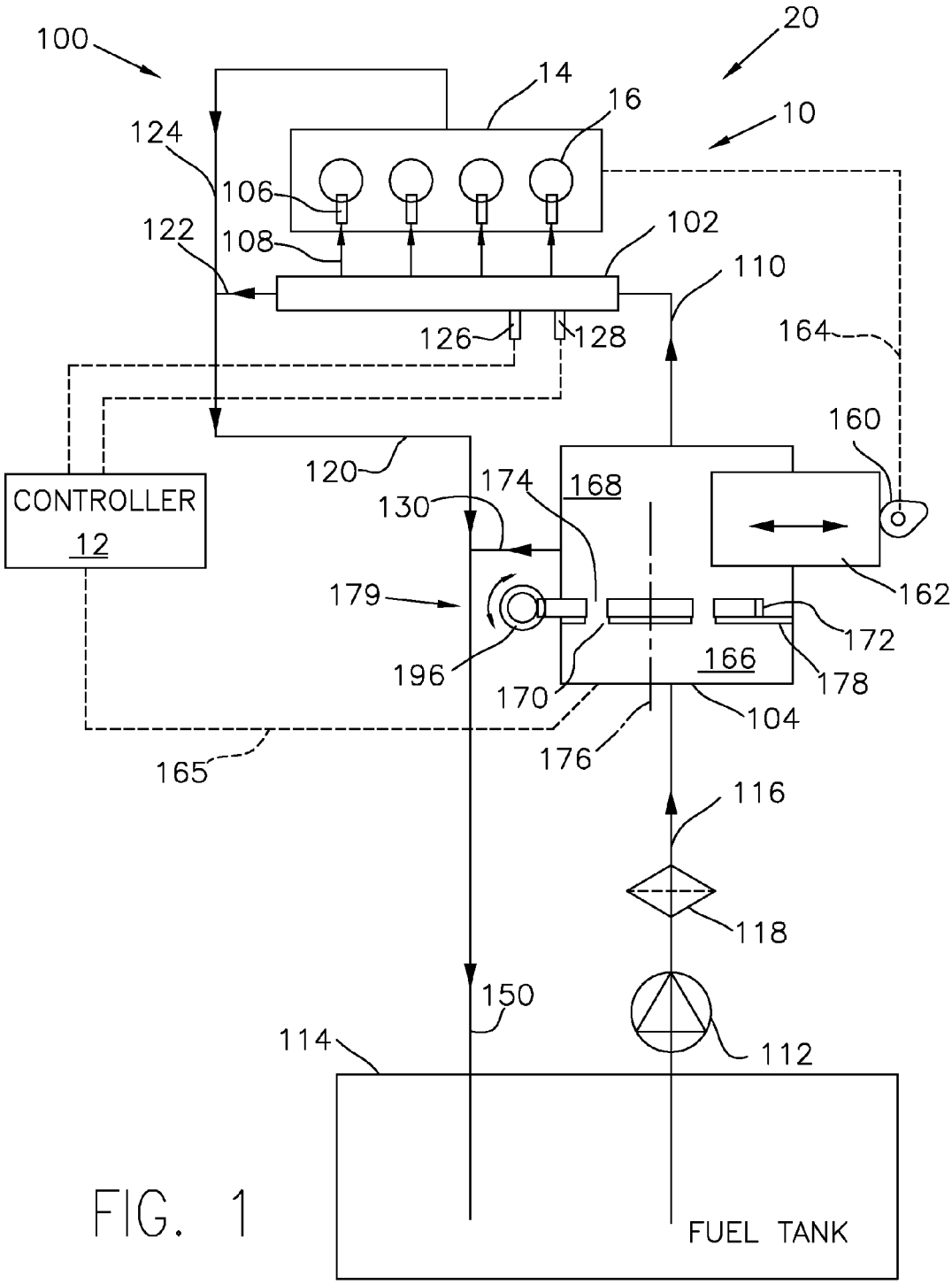
FIG. 1 illustrates an example vehicle system layout, including details of a fuel system.

The following description relates to a pump arrangement including a high pressure fuel pump for use with an internal combustion engine systems, and methods of operation of said pump arrangement. FIG. 1 depicts an example vehicle system 100. In the depicted embodiment, vehicle system 100 is a diesel-fueled vehicle system. The driving force of the vehicle system 100 may be generated by engine 10. Engine 10 may include one or more two banks 14. One bank 14 is indicated in the current example as having four cylinders 16. While engine 10 is shown as a four-cylinder/four-stroke engine, it will be appreciated that the engine may have a different cylinder configuration (e.g. in-line, V-shaped, or opposed) and/or a different number of cylinders (e.g. six or eight).

Engine 10 of the vehicle system 100 may include a fuel system 20. Fuel system 20 may include a fuel rail 102, a high pressure (HP) fuel pump or supply pump 104, and fuel injectors 106. Fuel rail 102 may provide a chamber for holding fuel for subsequent injection into cylinders 16 through fuel injectors 106. In the depicted example, the fuel rail 102 may provide pressurized fuel to fuel injectors 106 of the bank 14 along high-pressure injector passages 108. Fuel rail 102 may also include one or more fuel rail pressure sensors/switches 126 for sensing fuel rail pressures ($P_{fuel_rail}$) and one or more fuel rail temperature sensors 128 for sensing fuel rail temperatures ($T_{fuel_rail}$) and communicating the same with an engine controller 12. Only one fuel rail pressure sensor/switch 126 and one fuel rail temperature sensor 128 is shown for simplicity. Additional fuel rail pressure regulators may also be included. In the depicted example, fuel injectors 106 may be of the direct injection type. Further still, each cylinder 16 may include more than one injector.

Fuel may be pressurized by high pressure fuel pump 104 and transferred to the fuel rail 102 along high-pressure rail passage 110. In one example, high pressure fuel pump 104 may be driven by the rotation of engine 10, such as by an engine crankshaft and/or an engine camshaft. Alternatively, high pressure fuel pump 104 may be driven by an optional electric motor. The example shown here schematically illustrates a cam 160 in contact with a plunger 162 configured to regulate a pressure inside the fuel pump 104. The coupling of the engine operation to the motion of the plunger 162 is illustrated with a dashed line 164. Alternatively, or in addition to, the coupling 164 of the engine 10 to the plunger 162 and/or cam 160 to the movement of the plunger 162 may be coupled with the controller 12 as illustrated with a dashed line 165. In some cases the plunger 162 may be actuated and/or controlled by other means.

A low pressure feed pump 112 may be configured to draw low-pressure fuel from fuel tank 114 and feed it into supply pump 104 for subsequent pressurization and injection. In one example, fuel tank 114 may include a fuel type sensor (not shown) for determining a type of fuel in the tank. Low pressure fuel drawn by feed pump 112 may be transferred to high pressure fuel pump 104 along low pressure passage 116.

Fuel rail 102 may also be configured to return fuel, and thereby reduce fuel pressure, into low pressure recirculation passage 120 via rail return flow passage 122. A pressure reducing valve at the rail outlet (not shown) may regulate the return flow of fuel from the fuel rail 102 into recirculation passage 120. Similarly, fuel returned from injectors 106 may also be fed into recirculation passage 120 via injector return flow passage 124. High pressure fuel pump 104 may also be configured to return fuel, and thereby reduce fuel pressure into recirculation passage 120 via pump return flow passage 130. A pressure reducing valve at the pump's outlet (not shown) may regulate the return flow of fuel from the supply pump into the recirculation passage 120. As such, the fuel returned from the supply pump 104, injectors 106, and/or rail 102 may hereinafter also be referred to as the return fuel.

The low pressure fuel passage 116 may include a fuel filter 118 that may be located downstream from the fuel tank 114. The low pressure fuel pump 112 may be configured to pull fuel from the fuel tank 114 to direct it through the fuel filter 118 and further direct it towards the high pressure fuel pump 104. In some cases the pump 112 may be located within the fuel tank 114. The fuel filter 118 may also be located upstream from the fuel tank 114.

In some embodiments, a return flow valve may be included at the outlet of the injectors 106 to regulate the flow of injector return fuel into the recirculation passage 120. In alternate embodiments, a throttle may be used to regulate the flow of injector return fuel into the recirculation passage 120. A fuel cooler (not shown) may be optionally included in recirculation passage 120 for cooling the return fuel.

While the depicted example shows a single fuel filter 118, in alternate embodiments two or more filters may be included. Each filter may receive return fuel from respective recirculation branch passages. In one example, flow through each passage may be regulated by respective thermal recirculation valves. A pressure of fuel at the filter may be communicated to the engine controller 12 by a filter pressure sensor/switch (not shown) positioned at the outlet of the filter. Additional sensors, such as a fuel temperature sensor may also be included.

Feed pump 112, low pressure passage 116, recirculation passage 120, return flow passages 122, injector return flow passage 124, pump return flow passage 130, and first fuel filter 118 may constitute a low pressure section of the fuel system 20. Similarly, high pressure fuel pump 104, supply passages 110, high pressure injector passages 108, fuel rails 102, and injectors 106 may constitute a supply section of the fuel system 20. Other components may be included but may not be shown or described here.

Engine controller 12 may be coupled to various sensors and may be configured to receive a variety of sensor signals from said sensors. The sensors may include a vehicle speed sensor, a throttle opening-degree sensor, an engine rotational speed sensor, a battery state of charge sensor, an ignition switch sensor, a brake switch sensor, a gear sensor, and a driver request sensor. These sensors may also include temperature sensors such as an engine coolant temperature sensor, fuel rail temperature sensor 128, fuel rail pressure regulator, intake temperature sensor, and exhaust temperature sensor, in addition to various pressure sensors/switches including a fuel rail pressure sensor/switch 126 and a filter pressure sensor/switch. The engine controller 12 may also be coupled to various actuators of the vehicle system 100 and may be further configured to control the operation of the various actuators, including the fuel injectors 106, high pressure fuel pump 104, and a thermal recirculation valve.

The high pressure fuel pump 104 may include a supply chamber 166 and a pump chamber 168. There may be a passage 170 from the supply chamber 166 to the pump chamber 168. The pump 104 may also include a disk 172 that may have a hole or plurality of holes 174 therethrough. The disk 172 may be rotatable to place the hole or holes 174 in the disk 172 in varying degrees of alignment with the passage 170 to allow respective varying amounts of fuel to flow through the passage 170. The disk 172 may be configured to rotate about an axis 176. The flow of fuel may be from the supply chamber 166 to the pump chamber 168 or from the pump chamber 168 to the supply chamber 166. There may be a wall 178 separating the supply chamber 166 from the pump chamber 168. The passage 170 may be a hole or plurality of holes 170 in the wall 178. The disk 172 may be configured to rotate relative to the wall 178 and may be journaled for rotation on the wall 178. Collectively the wall 178 and the disk 172 may be referred to as a valve 179.

The controller 12 may be configured to control the rotational movement of the disk 172 in accordance with preselected operating conditions of the internal combustion engine 10. The controller 12 may therefore be configured to adjust the degrees of alignment of the hole or holes 174 and the passage 170 in accordance with one or more preselected operation conditions of the engine 10.

Figure 2:
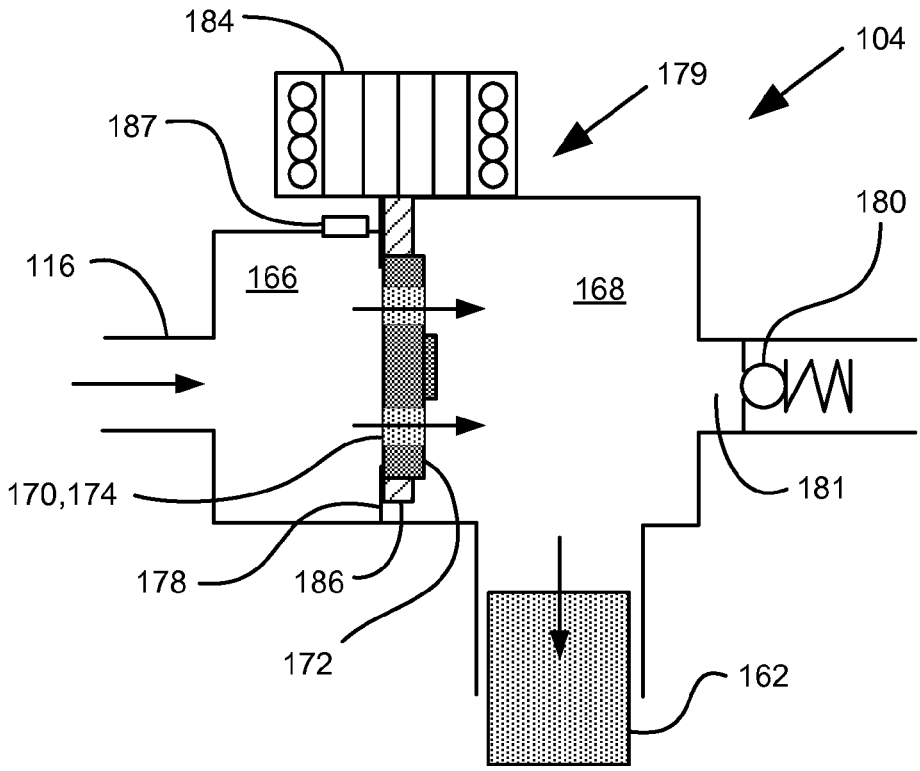
FIG. 2 is a partial cross-sectional view illustrating elements of an example pump arrangement.
Figure 3:
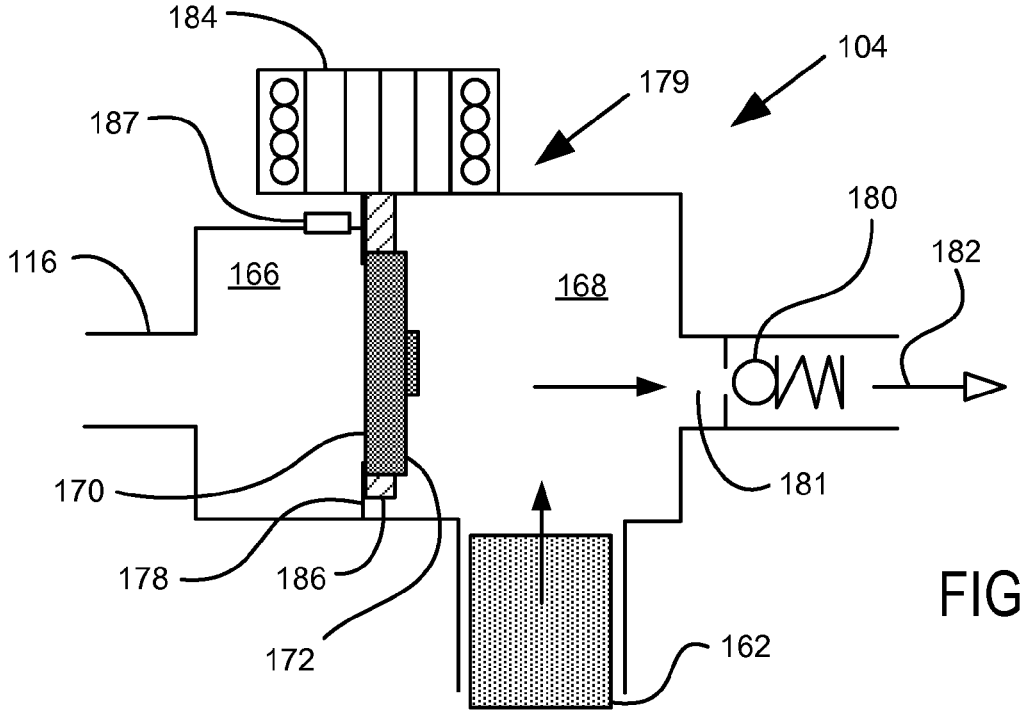
FIG. 3 is a partial cross-sectional view illustrating the example pump arrangement of FIG. 2 in a different position thereof.

FIGS. 2-3 are cross-sectional views illustrating an example high pressure fuel pump arrangement 104. FIG. 2 illustrates an intake stroke wherein a plunger 162 moves in a direction away from a pump chamber 168, decreasing a pressure therein. FIG. 3 further illustrates a delivery stroke wherein the plunger 162 moves in a direction into the pump chamber 168, increasing a pressure therein. Accordingly, the plunger 162 may be disposed to adjust the pressure inside the pump chamber 168, and may be further configured to at least partially control the flow from the supply chamber 166 to the pump chamber 168, or in the reverse direction.

FIGS. 2 and 3 depict stages of operation of pump 104 wherein the valve 179, comprising the wall 178 and disk 172, may be in an open, partially open, or closed position by means of alignment of one of more wall holes 170 and disk holes 174. In an example intake stroke (FIG. 2), the valve may at one point be open or partially open so as to allow fuel to flow (indicated by directional arrows) from supply chamber 166 into pump chamber 168. Fuel may also flow from low pressure fuel passage 116 into supply chamber 166 to replace the fuel supplied to the pump chamber 168. During a delivery stroke (FIG. 3), the valve 179 may at one point be closed so that no additional fuel enters pump chamber 168, thereby compressing fuel and/or forcing it towards a combustion chamber as indicated by directional arrows.

The pump 104 may include, or may be coupled with, a one-way valve 180 which may allow fuel to flow in a direction away from the pump chamber 168 during the delivery stroke as indicated by arrow 182. Arrow 182 may also indicate fuel flow towards a combustion chamber (located within cylinder 16 of the internal combustion engine 10 as shown in FIG. 1). The one way valve 180 may be located within an exit port 181, which may be attached to or contained within the pump chamber 168. The valve 180 may disallow fuel from flowing back into supply chamber 168 from exit port 181. The pressure differential between the chamber 168 and subsequent pressures downstream may further influence one-way valve 180 to open or close and/or facilitate fuel flow as indicated.

The pump arrangement 104 may include, or may be coupled with, a driving element 184 such as a stepper motor, DC motor, brushless DC motor or the like configured to rotate the disk 172. The driving element 184 may be coupled with the disk via a coupling 186 such as a shaft, gear arrangement, or other component. A position sensor 187 may be included to detect the position of the coupling 186, and/or the driving element 184.

Figure 4:
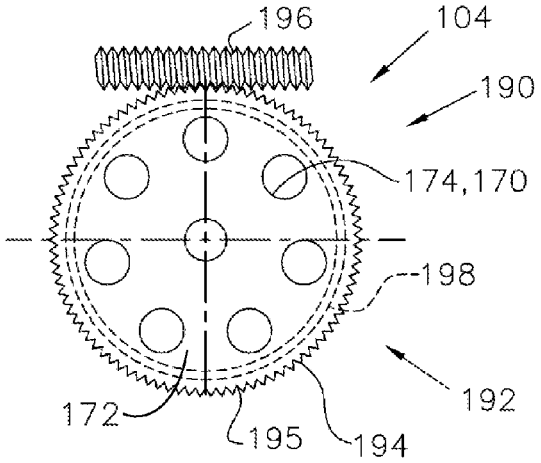
FIG. 4 is a partial cross-sectional view illustrating elements of another example pump arrangement.
Figure 5:
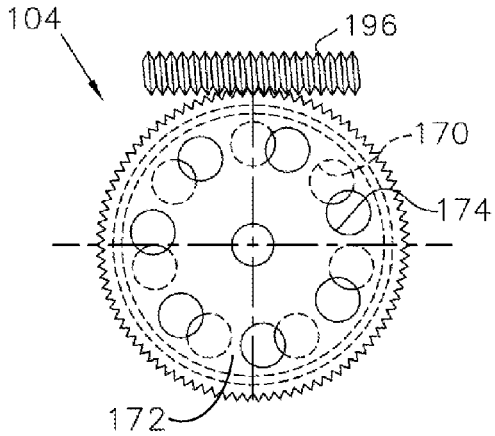
FIG. 5 is a partial cross-sectional view illustrating the example pump arrangement of FIG. 4 in a different position thereof.

FIGS. 4 and 5 are partial cross-sectional views illustrating elements of example pump arrangements 104 in accordance with the present disclosure. FIG. 4 illustrates an example wherein the hole in the disk 174 may be a plurality of holes arranged in a first pattern 190, and wherein the hole 170 in the wall is a plurality of holes 170 arranged in a second pattern 192. The first pattern 190 may be substantially similar to the second pattern 192 in size and arrangement. FIG. 4 shows the plurality of holes in the disk 174 in substantially complete alignment with the plurality of holes in the wall 170, while FIG. 5 shows the plurality of holes in the disk 174 in only partial alignment with the plurality of holes in the wall 170. The respective holes 174, 170 may be positioned in varying degrees of alignment that may include complete alignment, partial alignment, and no alignment at all thereby preventing any flow of fuel between the first chamber 166 and the second chamber 168.

FIGS. 4 through 7 illustrate examples wherein the disk 172 may have gear teeth 194 on a perimeter 195 thereof. The pump arrangement 104 may also include a worm 196 in meshing engagement with the gear teeth 194 that may be configured to drive the disk 172 for rotational movement. The pump arrangement 104 may include a stepper motor 184, DC motor, or brushless DC motor, or the like configured to drive the worm 196.

As shown previously in FIGS. 2 and 3, various example embodiments of the pump arrangement 104 may include a first chamber 166 separated from a second chamber 168 with a wall 178. There may be at least one hole 170 through the wall 178. A circular disk 172 may be in sealing engagement with one side of the wall 178 and may have gear teeth 194 on a perimeter 195 thereof. There may be at least one hole 174 in the disk 172. A worm 196 may be in meshing engagement with the gear teeth 194 of the circular disk 172. The worm 196 may be configured to drive the disk 172 for rotational movement to place at least one hole 174 in the disk 172 in varying degrees of alignment with at least one hole 170 through the wall 178 to allow respective varying amounts of fuel to flow between the first chamber 166 and the second chamber 168.

The pump arrangement 104 may include an exit port 181 (FIGS. 2 and 3) on the second chamber 168 to pass fuel from the second chamber 168 to a combustion chamber of the internal combustion engine 10. A plunger 162 may be configured to pressurize the second chamber 168 to force the fuel toward the combustion chamber. The controller 12 (FIG. 1) may be further configured to allow some fuel to pass from the second chamber 168 to the first chamber 166 when the plunger 162 forces fuel toward the combustion chamber. The controller 12 may also be configured to enable the driving element 184 to drive the worm gear 196 in accordance with preselected operating conditions of the internal combustion engine 10.

Figure 6:
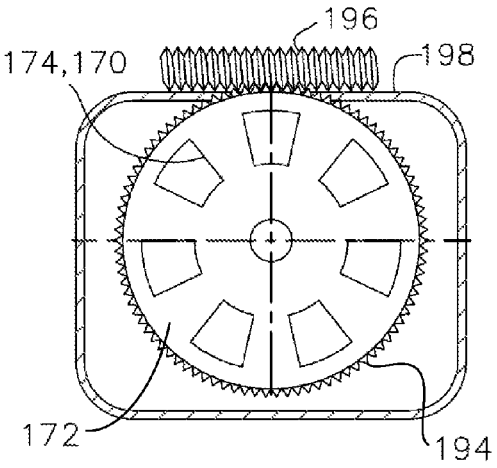
FIGS. 6 and 7 are partial cross-sectional views illustrating elements of other example pump arrangements.
Figure 7:
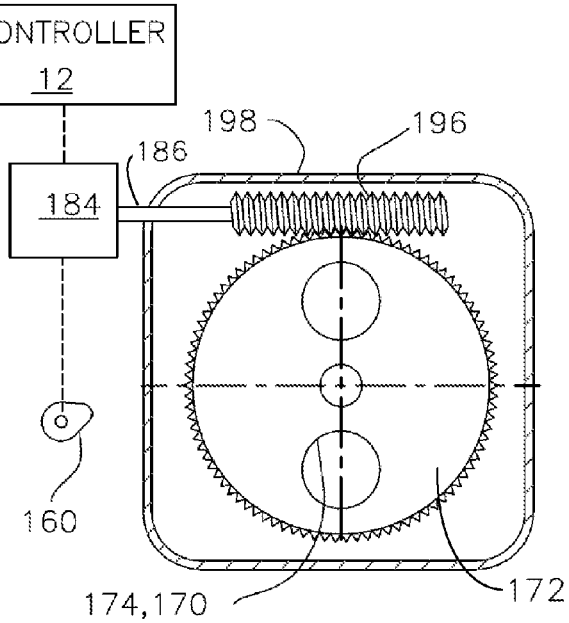

FIGS. 6 and 7 illustrate partial cross-sectional views of various example pump arrangements 104 in accordance with the present disclosure, including various pump housing 198 configurations. The one or more holes 174 in the disk 172 and the one or more holes 170 in the wall 178 may be one or more circular holes, rectangular holes, holes shaped as discoid segments, irregularly shaped holes, holes of changing cross-section as measured in a radial direction, or holes of changing cross-section as measured in a circumferential direction. Other patterns, hole shapes, and hole sizes may be used.

The fuel pump 104 may include a housing 198 which may be configured to enclose one or both of the supply chamber 166 and pump chamber 168 and may be configured to enclose part, or all, of the disk 172 and or part, or all, of the worm 196. For example, FIGS. 4 and 5 illustrate an example embodiment wherein all of the circumference of the disk 172 extends out of the housing 198, illustrated in dashed lines. FIG. 6 illustrates an example wherein the worm 196 is outside of the housing 198 and only a portion of the gear teeth 194 extend out of the housing 198. FIG. 7 illustrates an example wherein the worm 196 and the entire disk 172 are located inside of the housing 198. In the example shown in FIG. 7 a coupling 186 such as a shaft extends through the housing 198 to couple a motor 184 to the worm 196. Appropriate sealing configurations may be used to provide appropriate pressure inside the pump supply chamber 166 and pump chamber 168.

Returning to FIGS. 2 and 3, when the disk 174 holes are aligned with pump body holes, or holes 170 in the wall 178, the valve 179 may be considered to be in an open position. Fuel may then flow from fuel supply chamber 166 to the pump chamber 168 and vice versa. When the holes 170, 174 are aligned at the intake stroke and the pump plunger 162 moves down (FIG. 2) fuel may be forced from the supply chamber 166 to the pump chamber 168 to fill the space due to the plunger's downward movement. At an early part of the delivery stroke (FIG. 3) when the plunger 162 moves up, valve 179 may still stay open to spill unneeded fuel back to supply chamber 166 unless the engine 10 is in a wide open throttle condition. This may be because in partial throttle and idle conditions the engine may not need a full stroke of fuel. In this way there may be no impact by which noise is made in the valve opening process.

As shown in FIG. 1, a specific cam 160 may influence the position of the plunger 162 causing it to move up or down. FIG. 7 illustrates an example of utilizing said rotation of a cam 160 to cause a driving element 184 to become energized, whereby the disk 172 may rotate to a closed position. Fuel may then be trapped in the pump chamber 168 and may not flow back to supply chamber 166. The fuel may then be compressed to force the one way valve 180 (FIGS. 2-3) open to force the fuel into the fuel rail 102 at a desired pressure. Again, since disk 172 rotates, there is no impact between the disk 172 and the wall 178.

When receiving a trigger signal, the driving element 184 may rotate the disk 172 to put the valve 179 in open and closed positions. The timing of the trigger signal may be calculated from one or more predetermined positions of the cam 160 and/or may be based on engine fuel, fuel pressure demand, and/or another determination. Similarly, controller 12 may control the triggering and/or timing of the driving element 184 so as to rotate the disk 172. The controller 12 may thereby adjust the degrees of alignment of the holes of the disk 174 and the passage holes 170 in accordance with one or more preselected operation conditions of the engine.

Figure 8:
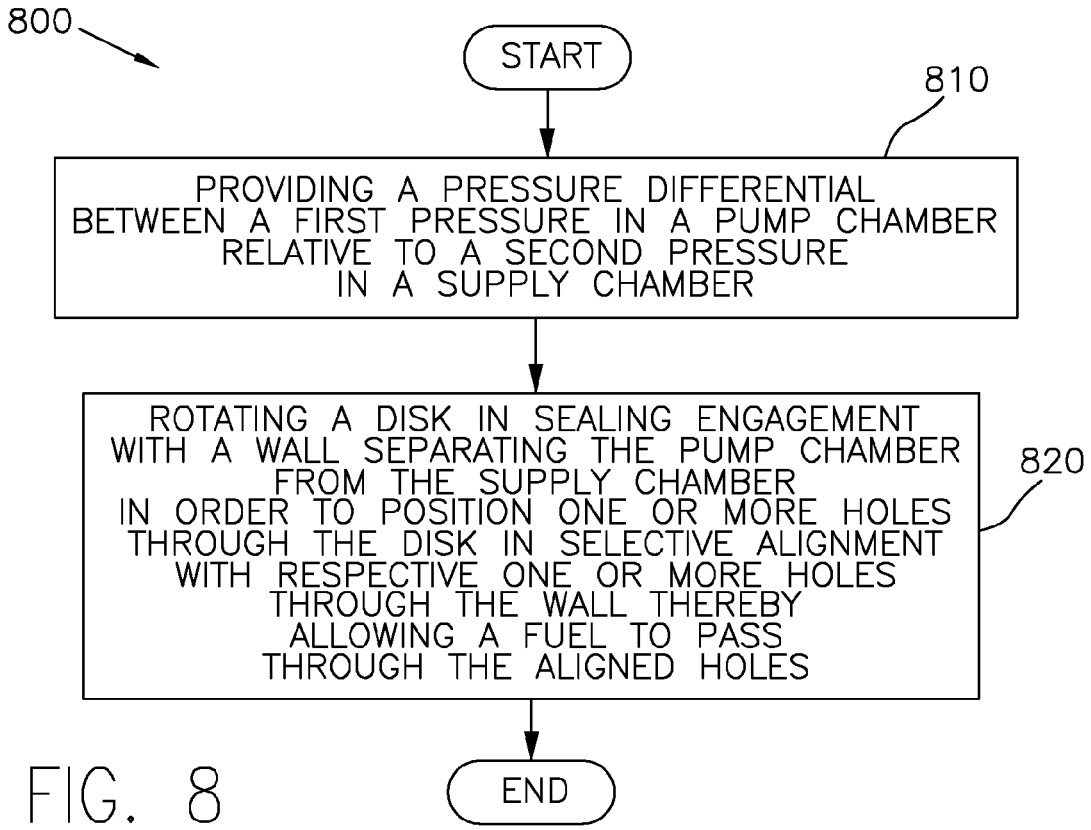
FIG. 8 is a flow diagram which shows an example method of operation of a high pressure fuel pump for use with an internal combustion engine.

FIG. 8 is a flow diagram which shows an example method of operation of a high pressure fuel pump for use with an internal combustion engine. The method 800 may include, at 810, providing a pressure differential between a first pressure in a pump chamber relative to a second pressure in a supply chamber. The method 800 may also include, at 820, rotating a disk in sealing engagement with a wall separating the pump chamber from the supply chamber in order to position one or more holes through the disk in selective alignment with respective one or more holes through the wall, thereby allowing a fuel to pass through the aligned holes. In this way the high pressure fuel pump may be made to operate more quietly as no impact between parts may occur.

Figure 9:
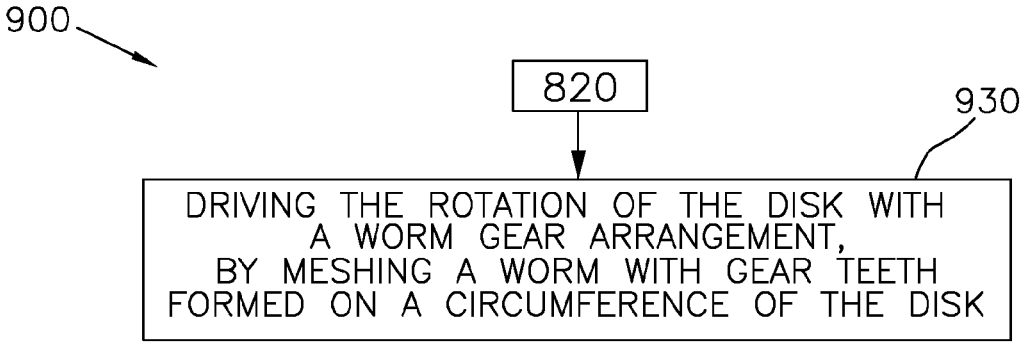
FIG. 9 is a flow diagram which shows an example variation of the method illustrated in FIG. 8.

FIG. 9 is a flow diagram which shows an example variation of the method illustrated in FIG. 8. The method 900 may include at 930, driving the rotation of the disk with a worm gear arrangement, by meshing a worm with gear teeth formed on a circumference of the disk. Driving the worm may be done with one of: a stepper motor, a DC motor, and a DC brushless motor. Added components may be integrated to drive the pump arrangement such as gear arrangements, driving elements, shafts, etc.

Figure 10:
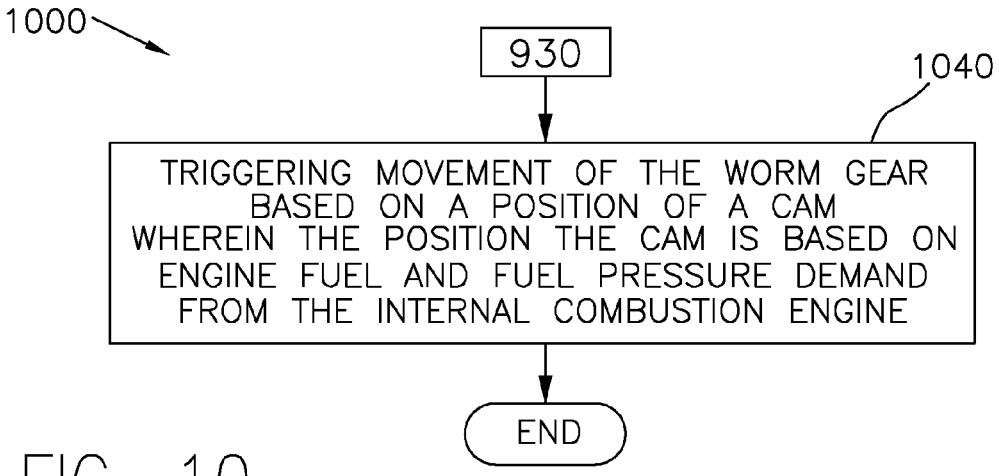
FIG. 10 is a flow diagram which shows an example variation of the method illustrated in FIG. 9.

FIG. 10 is a flow diagram which shows an example variation of the method illustrated in FIG. 9. The method 1000 may also include at 1040, triggering movement of the worm gear based on a position of a cam wherein the position of the cam is based on engine fuel and fuel pressure demand from the internal combustion engine. The cam may be utilized for additional purposes such as positioning of a plunger in the pump chamber for compression of fuel, or influencing fuel flow out of the pump chamber.

Figure 11:
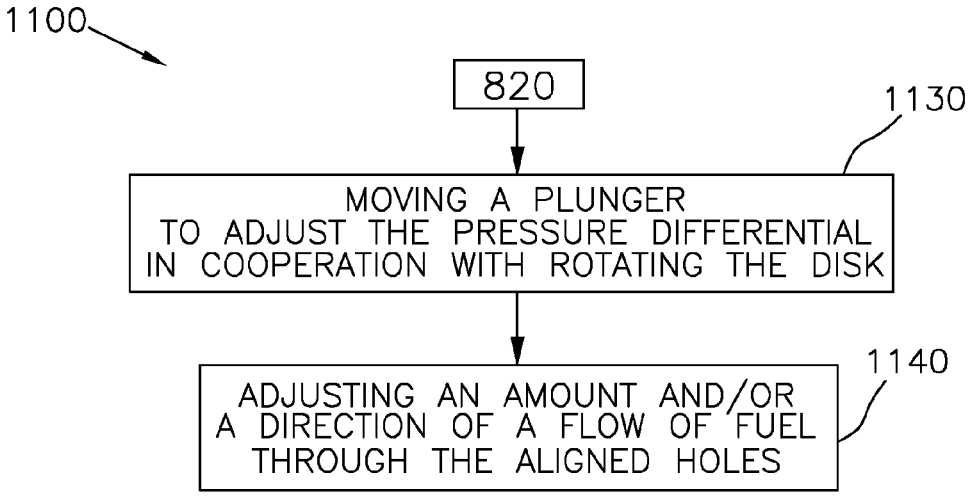
FIG. 11 is a flow diagram which shows an example variation of the method illustrated in FIG. 8.

FIG. 11 is a flow diagram which shows an example variation of the method illustrated in FIG. 8. The method 1100 may also include at 1130, moving a plunger to adjust the pressure differential in cooperation with rotating the disk. The method 1100 may also include at 1140 adjusting an amount and/or a direction of a flow of fuel through the aligned holes.

The specific routines described herein may represent one or more of any number of processing strategies such as event-driven, interrupt-driven, multi-tasking, multi-threading, and the like. As such, various actions, operations, or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, functions, or operations may be repeatedly performed depending on the particular strategy being used. Further, the described operations, functions, and/or acts may graphically represent code to be programmed into computer readable storage medium in the control system Further still, it should be understood that the systems and methods described herein are exemplary in nature, and that these specific embodiments or examples are not to be considered in a limiting sense, because numerous variations are contemplated. Accordingly, the present disclosure includes all novel and non-obvious combinations of the various systems and methods disclosed herein, as well as any and all equivalents thereof.

The invention claimed is:

1. A high pressure fuel pump for an internal combustion engine comprising:

a supply chamber;

a pump chamber;

a passage from the supply chamber to the pump chamber; and a disk having a hole therethrough, the disk being rotatable to place the hole in the disk in varying degrees of alignment with the passage to allow respective varying amounts of fuel to flow through the passage.

2. The high pressure fuel pump of claim 1, further comprising a plunger disposed to adjust the pressure inside the pump chamber.

3. The high pressure fuel pump of claim 1, further comprising a controller configured to adjust the degrees of alignment of the hole and the passage in accordance with one or more preselected operation conditions of the engine.

4. The high pressure fuel pump of claim 1, further comprising a wall separating the supply chamber from the pump chamber, and wherein the passage is a hole in the wall.

5. The high pressure fuel pump of claim 4, wherein the hole in the disk is a plurality of holes arranged in a first pattern, and wherein the hole in the wall is a plurality of holes arranged in a second pattern, and wherein the first pattern is similar to the second pattern in size and arrangement.

6. The high pressure fuel pump of claim 1, wherein the disk has gear teeth on a perimeter thereof, further comprising a worm in meshing engagement with the gear teeth configured to drive the disk for rotational movement.

7. The high pressure fuel pump of claim 1, further comprising a one way valve configured to allow fuel to flow in a direction from the supply chamber to a combustion chamber of the internal combustion engine, and to not allow fuel to flow in an opposite direction.

8. A pump arrangement comprising:

a first chamber separated from a second chamber with a wall;

at least one hole through the wall;

a circular disk in sealing engagement with one side of the wall having gear teeth on a perimeter thereof;

at least one hole in the disk; and a worm in meshing engagement with the gear teeth of the circular disk configured to drive the disk for rotational movement to place the at least one hole in the disk in varying degrees of alignment with the at least one hole through the wall to allow respective varying amounts of fuel to flow between the first chamber and the second chamber, wherein the varying degrees of alignment include complete alignment, partial alignment, and no alignment at all thereby preventing any flow of fuel between the first chamber and the second chamber.

9. The pump arrangement of claim 8, further comprising an exit port on the second chamber to pass fuel from the second chamber to a combustion chamber of an internal combustion engine; and a plunger configured to pressurize the second chamber to force the fuel toward the combustion chamber.

10. The pump arrangement of claim 8, further comprising a controller configured to control the rotational movement of the disk in accordance with preselected operating conditions of an internal combustion engine configured to receive fuel from the second chamber.

11. The pump arrangement of claim 10, further comprising an exit port on the second chamber to pass fuel from the second chamber to a combustion chamber of the internal combustion engine; a plunger configured to pressurize the second chamber to force the fuel toward the combustion chamber; and wherein the controller is further configured to allow some fuel to pass from the second chamber to the first chamber when the plunger forces fuel toward the combustion chamber.

12. The pump arrangement of claim 8, further comprising a stepper motor configured to drive the worm.

13. The pump arrangement of claim 8, wherein the fuel is selectively forced from the second chamber to an internal combustion engine; and further comprising a controller configured to drive the worm gear in accordance with preselected operating conditions of the internal combustion engine.

14. The pump arrangement of claim 8, wherein the one or more holes in the disk and the one or more holes in the wall are one or more of: circular holes, rectangular holes, holes shaped as discoid segments, irregularly shaped holes, holes of changing cross-section as measured in a radial direction, and/or holes of changing cross-section as measured in a circumferential direction.

15. A method of operation of a high pressure fuel pump coupled to an engine, comprising:

generating a pressure differential between a first pressure in a pump chamber relative to a second pressure in a supply chamber; and rotating a disk in sealing engagement with a wall separating the pump chamber from the supply chamber in order to position one or more holes through the disk in selective alignment with respective one or more holes through the wall; and passing fuel through the aligned holes.

16. The method of claim 15, further comprising driving the rotation of the disk with a worm gear arrangement, by meshing a worm with gear teeth formed on a circumference of the disk.

17. The method of claim 16, further comprising driving the worm with one of: a stepper motor, a DC motor, and a DC brushless motor.

18. The method of claim 16, further comprising triggering movement of the worm gear based on a position of a cam wherein the position of the cam is based on engine fuel and fuel pressure demand from the engine.

19. The method of claim 15, further comprising moving a plunger to adjust the pressure differential in cooperation with rotating the disk and adjusting an amount and/or a direction of a flow of fuel through the aligned holes.

* * * * *